VACUUM DEGASSING APPARATUS

BACKGROUND OF THE INVENTION

The present invention relates to a vacuum degassing apparatus and more particularly to a vacuum degassing apparatus for use in a vacuum siphon degassing process or in a vacuum circulation degassing process.

It has been known that properties of a metal or an alloy can be considerably improved by treating it in a vacuum.

In the vacuum siphon degassing process (DH process), a vessel is evacuated with a tube extending from the bottom of the vessel immersed in a molten steel in a ladle. The molten steel is sucked up by the difference in pressure between the surrounding atmosphere and the inside of the vacuum vessel and is progressively degassed therein. By moving the vacuum vessel up and down the molten steel is repeatedly sucked into and discharged from the vessel to thereby make the degassing of the molten steel proceed.

In the vacuum circulation degassing process (RH process), the vessel is evacuated with two tubes extending from the bottom of the vessel immersed in the molten steel in the ladle. By injecting argon gas from the lower end of one of the tubes the molten steel is sucked into the vacuum vessel and degassed therein. The degassed molten steel returns to the ladle through the other tube.

Thus, the two degassing processes have the feature in common that the molten steel is made to circulate or flow between the ladle and the vacuum vessel and is degassed in the vacuum vessel. The apparatuses heretofore employed in these degassing processes were open to the atmosphere at the top of the ladle and, accordingly, had the disadvantage that gas would permeate into the molten steel in the ladle through the slag and reduce the degassing efficiency. In order to prevent the absorbing reaction of the molten steel with the gas from the atmosphere, it has been proposed that the vacuum vessel and the ladle should be contained within a sufficiently large container which is then either evacuated or filled with, for example, an inert gas prior to degassing treatment. This proposal is, however, not suitable because of the huge volume of the container which will require a high cost to build and a long period of time to replace the air within the container.

Accordingly, it is the object of the present invention to provide a vacuum degassing apparatus for use in a DH process or an RH process capable of economically preventing the reduction in degassing efficiency and effectively performing degassing treatment in a short period of time.

SUMMARY OF THE INVENTION

In the vacuum degassing apparatus for use in a DH process or an RH process according to the present invention, a cover is provided at the top of the ladle and a tube fixed to the bottom of the vacuum vessel extends through an opening of the cover and is immersed partially in the molten steel in the ladle. In order to prevent the penetration of the ambient air into the ladle, an inert gas may be forced through an opening of the cover into the space between the top surface of the molten steel in the ladle and the cover. More preferably, a bellows is attached to the bottom of the vacuum vessel so as to surround the tube and to enclose the gap between the tube and the opening of the cover.

The bellows may be mechanically connected between the vacuum vessel and the cover or may have such a construction that the upper end thereof is fixed to the bottom of the vacuum vessel and the lower end thereof is provided with weights along the peripheral edge of the lower end thereof so that the lower end of the bellows is made to freely contact the top surface of the cover by the weights.

In order to facilitate the attachment and removal of the cover to and from the ladle and to ensure the safety of the operation, a cover mounting and demounting mechanism may be provided on the raising and lowering support for the vacuum vessel. Said mounting and demounting mechanism comprises a winch drive unit at the top of the raising and lowering support, and said unit is connected with the cover by ropes or chains. When said winch unit is driven, the cover is moved up or down through the ropes or chains and attached to or removed from the top of the ladle.

BRIEF DESCRIPTION OF THE DRAWINGS

The invention will be better understood from the following description taken in connection with the accompanying drawings in which.

DESCRIPTION OF THE PREFERRED EMBODIMENTS

Figure 1:
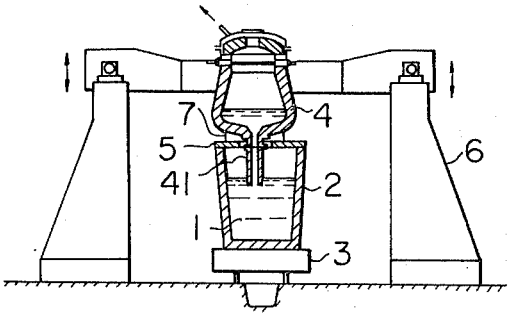
FIG. 1 is a schematic vertical sectional view of an apparatus according to the present invention applied in a mechanism for performing a DH process.

Referring now to the drawings certain embodiments of the present invention will be described. In FIG. 1 there is shown a schematic vertical sectional view of the apparatus according to the present invention applied in a mechanism particularly for performing a DH process, in which a ladle 2 filled with molten steel 1 is mounted on a truck 3 and transported thereby to beneath a vacuum vessel 4. A cover 5 is placed on the top of the ladle 2 at an appropriate position during transportation thereof. The vacuum vessel 4 is supported by a raising and lowering support 6. When the ladle 2 comes beneath the vacuum vessel 4, the vessel 4 is lowered until a tube 41 extending from the bottom of the vessel 4 passes through an opening 51 (see FIG. 3) of the cover 5 and is immersed partially into the molten steel 1 in the ladle 2.

Figure 2:
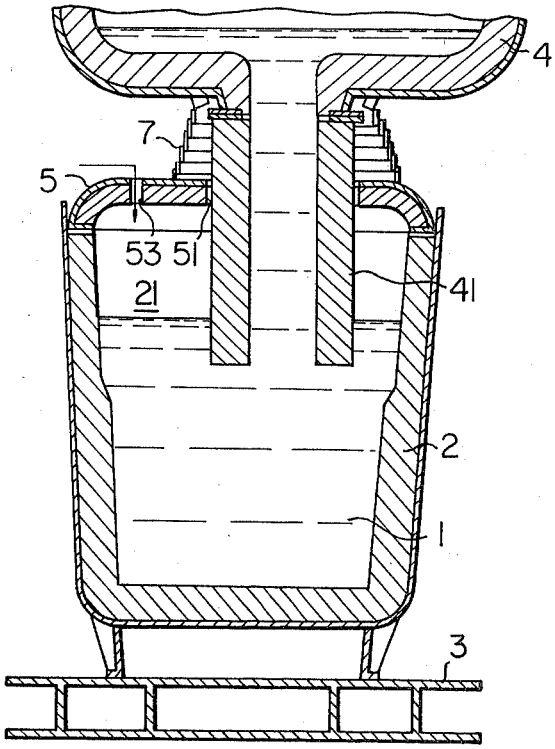
FIG. 2 is an enlarged vertical sectional view of a portion of the apparatus of FIG. 1.
Figure 3:
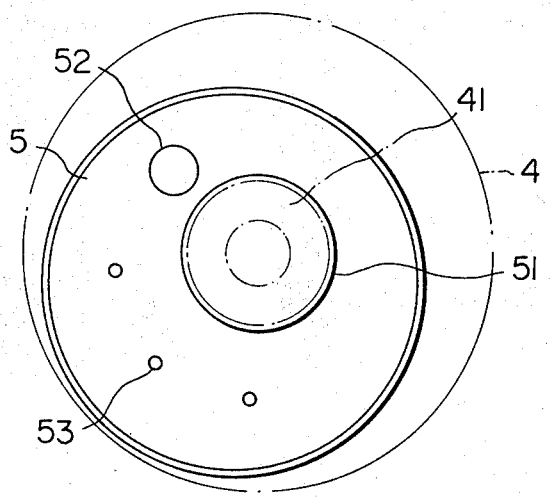
FIG. 3 is a plan view of the cover.
Figure 4:
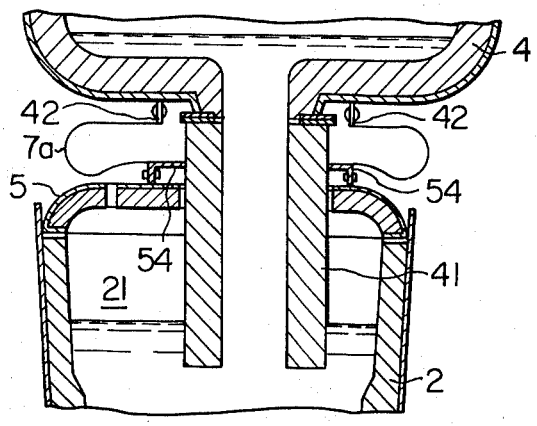
FIGS. 4 and 5 are vertical sectional views of other embodiments of the bellows.
Figure 5:
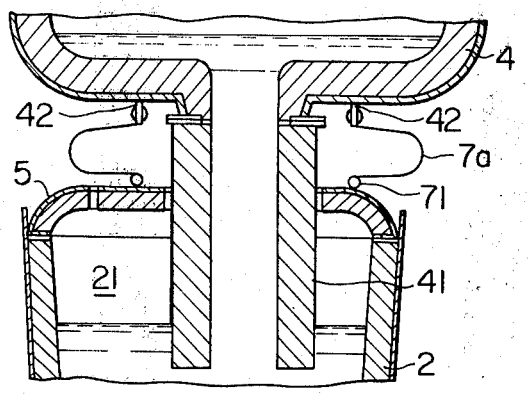
Figure 6:
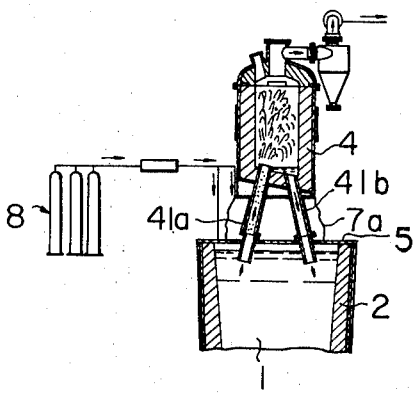
FIG. 6 is a schematic vertical sectional view of the apparatus according to the present invention applied in a mechanism for performing a RH process.
Figure 7:
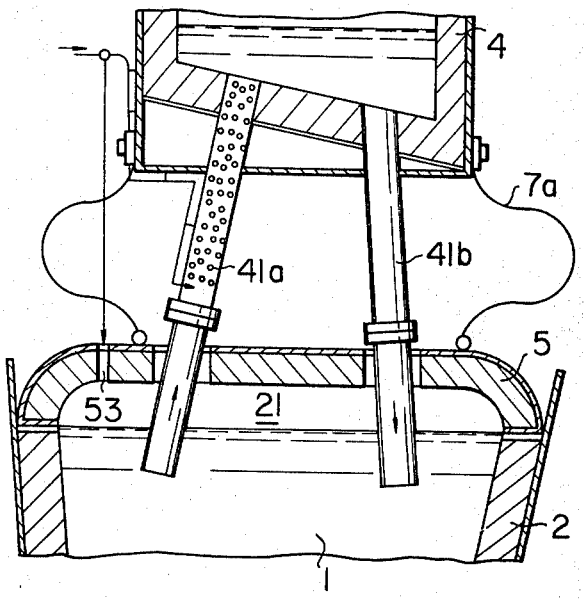
FIG. 7 is an enlarged vertical sectional view of a portion of the apparatus of FIG. 6.
Figure 8:
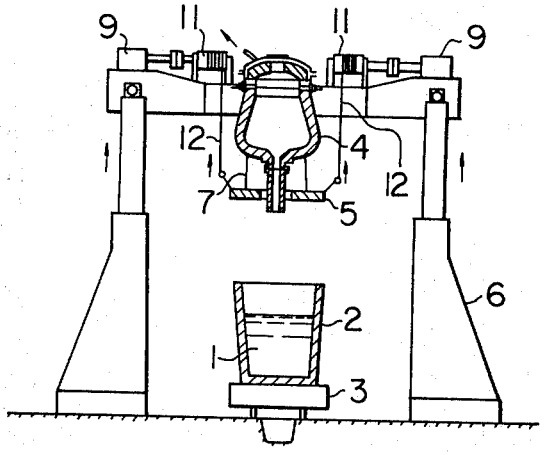
FIG. 8 is a schematic vertical sectional view of another embodiment of the apparatus of FIG. 1.

FIG. 2 is an enlarged vertical sectional view illustrating the relationship between the ladle 2 and the vacuum vessel 4 of FIG. 1. The cover 5 is a sealing cover for the top of the ladle 2 and is formed by lining an iron plate with a refractory material. In addition to the opening 51 for the pipe 41 of the vessel 4, the cover 5 has, as shown in FIG. 3, a normally-closed opening 52 for sampling the molten steel and an opening 53 for inert gas supply. A bellows 7 is provided between the bottom of the vacuum vessel 4 and the top of the cover An example of the degassing effect provided by vacuum degassing apparatus according to the present invention is shown in the following table:

Table

| | Degassing Efficiency |
|---|---|
| Apparatus according to the present invention (Example 1) | 105% |
| Apparatus according to the present invention (Example 2) | 120% |
| Oxygen content in the upper sealed space of the ladle was 4% | |
| Prior art apparatus | 100% |

As shown in the above table, the apparatus according to the present invention provides an increase in the degassing efficiency of 5 – 20% over the prior art apparatus.

As heretofore described, the present invention is characterized in that the vacuum degassing treatment is carried out with the upper space of the ladle isolated from the atmosphere outside of it. The present invention provides a significant effect to produce steel of high quality in a short period of time by keeping detrimental gas such as hydrogen, nitrogen and oxygen from penetrating into the molten steel using a mechanism which is economical to manufacture and easy to operate.

While we have shown and described specific embodiments of our invention, it will be understood that these embodiments are merely for the purpose of illustration and description and that various other forms may be devised within the scope of our invention, as defined in the appended claims.

We claim:

1. An improved vacuum degassing apparatus for degassing molten steel in a vacuum vessel by flowing the molten steel between a ladle and the vacuum vessel through a tube, the improvement comprising:

a cover having an opening for receiving said tube therethrough and removably mountable on the top of said ladle;

a raising and lowering support provided with a mechanism for supporting said vacuum vessel and raising and lowering the same; and a mechanism provided with a winch drive unit mounted on said raising and lowering support and connected with said cover through ropes or chains, for mounting and demounting said cover to and from said ladle.

2. An apparatus according to claim 1, wherein said cover is provided with an inert gas supplying opening through which the inert gas from a source of supply thereof is forced into said ladle.

3. An improved vacuum degassing apparatus for degassing molten steel in a vacuum vessel by flowing the molten steel between a ladle and the vacuum vessel through a tube, the improvement comprising:

a cover having an opening for receiving said tube therethrough and removably mountable on the top of said ladle;

a bellows surrounding said tube and attached to the bottom of said vacuum vessel, for enclosing the gap between said tube and said opening of the cover;

a raising and lowering support provided with a mechanism for supporting vessel and raising and lowering the same; and a mechanism provided with a winch drive unit mounted on said raising and lowering support and connected with said cover through ropes or chains, for mounting and demounting said cover to and from said ladle.

4. An apparatus according to claim 3, wherein said bellows is formed of a flexible fire-resistant material, and said bellows is attached at the upper end thereof to the bottom of said vacuum vessel and provided along the peripheral edge of the lower end thereof with weights so that the lower end of said bellows is freely contactable onto the top face of said cover.

5. An apparatus according to claim 3, wherein said cover is provided with an inert gas supplying opening through which the inert gas from a source of supply thereof is forced into said ladle.

* * * * *

United States Patent [19]

Duchemin

[11] 3,975,005

[45] Aug. 17, 1976

[54] VEHICLE SUSPENSION SPRING

[75] Inventor: Michel Leon Duchemin, Douai, France

[73] Assignee: Ressorts du Nord S.A., Paris, France

[22] Filed: Mar. 19, 1975

[21] Appl. No.: 559,784

[30] Foreign Application Priority Data

Mar. 27, 1974 France ..... 74.10654

[52] U.S. Cl. ..... 267/47

[51] Int. Cl.[2] ..... F16F 1/18

[58] Field of Search ..... 267/47, 36, 42, 43, 267/44, 36 A, 45, 49, 19 R, 19 A, 158; 280/124 R

[56] References Cited

UNITED STATES PATENTS

| | | | |
|---|---|---|---|
| 1,818,040 | 8/1931 | Carteret | 267/47 |
| 3,705,718 | 12/1972 | Fukui et al. | 267/47 |
| 3,814,410 | 6/1974 | Fukui et al. | 267/47 |

*Primary Examiner*—James B. Marbert

*Attorney, Agent, or Firm*—Burns, Doane, Swecker & Mathis

[57] ABSTRACT

The spring comprises at least one spring leaf formed from a bar having a circular cross-section and flattened progressively toward each end. The portions of the bar defining the ends have a substantially rectangular cross-section. The center part of the bar is cylindrical.

The flattened ends may be rolled round onto themselves to form eyes for the passage of spring fastening means.

The spring may have a plurality of such leaves and for a secondary leaf devoid of eyes.

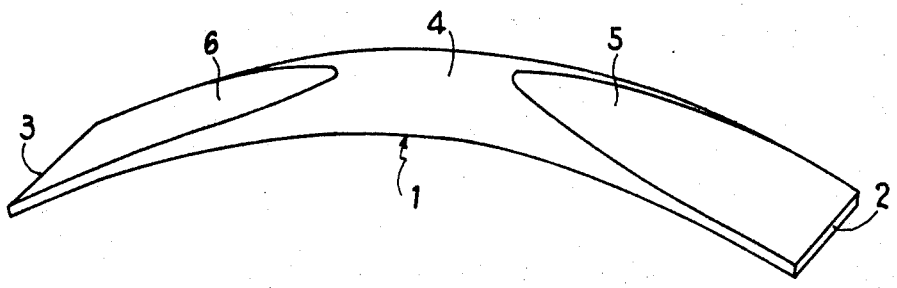

8 Claims, 6 Drawing Figures